US007814826B2

(12) United States Patent
Ribas-Blanes

(10) Patent No.: US 7,814,826 B2
(45) Date of Patent: Oct. 19, 2010

(54) MACHINES FOR MAKING BALES OF DISGREGATED MATERIAL

(75) Inventor: Lorenzo Ribas-Blanes, Sabadell (ES)

(73) Assignee: Amadeo Farell S.A.U., Barcelona (ES)

( * ) Notice: Subject to any disclaimer, the term of this patent is extended or adjusted under 35 U.S.C. 154(b) by 0 days.

(21) Appl. No.: 11/878,235

(22) Filed: Jul. 23, 2007

(65) Prior Publication Data

US 2009/0025576 A1 Jan. 29, 2009

(51) Int. Cl.
*B30B 1/00* (2006.01)
*B30B 15/32* (2006.01)

(52) U.S. Cl. ..... 100/188 R; 100/50; 100/192; 100/218; 100/232; 100/245; 100/253; 100/126; 100/131

(58) Field of Classification Search ..... 100/3, 100/110, 126, 127, 131, 215, 218, 226, 232, 100/240, 245, 48, 49, 50, 188 R, 191, 192, 100/253

See application file for complete search history.

(56) References Cited

U.S. PATENT DOCUMENTS 3,438,319 A * 4/1969 Raab ..... 100/35
3,451,185 A * 6/1969 Tezuka ..... 53/397
3,762,310 A * 10/1973 Wright ..... 100/3
3,968,619 A * 7/1976 Fishburne ..... 53/399
4,658,719 A 4/1987 Jackson et al.
4,691,628 A * 9/1987 Simpson ..... 100/37
5,007,337 A 4/1991 Newsom et al.
5,201,266 A * 4/1993 Schmalz et al. ..... 100/35
5,463,944 A 11/1995 Wolf et al.
5,558,014 A 9/1996 Robinson et al.
6,308,618 B1 * 10/2001 Richard et al. ..... 100/37

FOREIGN PATENT DOCUMENTS

EP 677376 A1 * 10/1995
ES 2 112 124 3/1998
ES 2 277 779 7/2007

OTHER PUBLICATIONS

International Search Report dated Jun. 11, 2007 for corresponding priority application No. ES 2 277 779.

* cited by examiner

*Primary Examiner*—Jimmy T Nguyen
(74) *Attorney, Agent, or Firm*—Staas & Halsey LLP

(57) ABSTRACT

Machines for making bales of disgregated materials, including a compacting chamber in which a pressing member moves towards and away from a stopping point for compacting the disgregated materials, the chamber having a larger lower surface which has a substantially flat surface provided with runoff holes, smaller surfaces each having a frame which serves as an attachment flange, an output door arranged to move in a vertical direction irrespective of whether the pressing plate has reached the stopping point, wherein the capacity of the chamber is variable to accommodate a possible excess in the disgregated materials introduced into the chamber to be compacted, and a telescopic box having on at least one of its walls through holes located in the proximity of the door.

9 Claims, 6 Drawing Sheets

MACHINES FOR MAKING BALES OF DISGREGATED MATERIAL

BACKGROUND OF THE INVENTION

This invention relates to improvements in the machines for making bales of disgregated materials, with the latter term of disgregated materials comprising urban rubbish, waste products and industrial byproducts which, once formed into compact bales, are deposited, forming stable layers, separated by layers of artificial aggregates, in dumps where the products making up said bales are biodegraded in a controllable manner or said bales are stored to be processed or incinerated subsequently.

Such bales are made in horizontally arranged pressing machines that comprise a compacting chamber which, with a parallelepiped shape, on one of the medium faces of the chamber receives, all over its surface, the action of a pressing plate, while on one of the small faces of the chamber, again all over it, the action of an expulsion plate is received, either withstanding the pressure of the bale formation operation, or acting upon said bale to remove it from the compacting chamber and, finally, on another of the smaller faces of the chamber, the machine has a door which opens in the horizontal direction to allow the compacted bale to be expelled.

These pressing machines for making bales of disgregated materials usually have a longitudinal structure, which includes a feeding hopper for the compacting chamber and which contains the hydraulic cylinder that drives the pressing plate, at the end of which there is the compacting chamber which, according to the space where the pressing machine is to be installed, the expulsion and bale exit plate equipment, is arranged on one side or the other of said longitudinal structure. This means the machine arrangement is predetermined by the manufacturing order, and therefore the manufacturers of these pressing machines cannot mass produce said machines, and consequently they are more costly.

Moreover, when the disgregated material is wet (organic rubbish and waste) liquids are released during the pressing action which means that the chamber and its surrounding areas become damp and are inundated by these squeezed liquids, which can produce rust in the compacting chamber and a polluted atmosphere that is unsuitable for the working environment.

Also, as the openable door in the compacting chamber opens in the horizontal direction, this means that, in some cases, the material becomes partially decompacted, and consequently the bale is not acceptable and the material must be returned to the feeding hopper to be compacted again.

According to another aspect, with respect to the mass of disgregated material to be compacted in a bale, the problem arises whereby owing to the accidental interlaying of a portion of incompactible mass or the also accidental excess of introduced mass, the pressing plate cannot reach the stopping point, and consequently the process is interrupted, in which case, what normally happens is that the workers undertake the very cumbersome task of unloading the compacting chamber, which implies wasted effort and a considerable reduction in the production rate.

Finally, there is also the drawback that between one compact bale, which is at the beginning of the telescopic box, and a bale that is being expelled, a chamber of air is created which produces a variable pushing force against the former by the latter, which varies the precision of the bale strapping.

SUMMARY OF THE INVENTION

In order to overcome such drawbacks, solutions have been adopted that are the object of these improvements and which are defined in the following points:

a.—the larger lower face of the compacting chamber is made up of a substantially flat surface provided with runoff means for the liquids contained in the material to be compacted and that flow during the pressing operation;

b.—each of the smaller faces of the compacting chamber has, in equal conditions, a frame arrangement which, acting as an attachment flange, allows the compact bale expulsion equipment and the bale output equipment, including the telescopic shaping chamber, the strapping device and the waiting station for unloading the finished bales, to be connected in alternate ways to the machine;

c.—the output door is arranged so that it only moves in the vertical direction irrespective of whether the pressing plate has reached the stopping point;

d.—the capacity of the compacting chamber is variable according to a possible excess in the introduced mass to be compacted, corresponding to a normal bale; and e.—the telescopic box has on at least one of its walls, bottom wall and/or roof through holes located in the proximity of the openable door.

Another characteristic of the invention is that the compact bale expulsion equipment is attached to the flange of the compacting chamber corresponding to the smaller face thereof which is located to the left of the pressing plate, while the compact bale output equipment, together with the strapping device thereof and the unloading station of the finished bales, is attached to the flange of said compacting chamber corresponding to the smaller face located to the right of the pressing plate.

Another characteristic of the invention is that the compact bale expulsion equipment is attached to the flange of the compacting chamber corresponding to the smaller face thereof which is located to the right of the pressing plat, while the compact bale output equipment, together with the strapping device thereof and the unloading station for the finished bales, is attached to the flange of said compacting chamber corresponding to the smaller face located to the left of the pressing plate.

Another characteristic of the invention lies in the fact that the machine, in the event excess material is detected in the compacting machine by a pressure switch 17*a* that signals the pressing plate is unable to reach the stopping point, can create an increased capacity of the compacting chamber, i.e., an expansion volume, by having the expulsion plate retract, wherein the excess material is fed in the expansion volume by driving the pressing plate until it reaches its stopping point set by end stops, at which moment the door, which closes the exit to the chamber while the material making up the bale is compacted, opens, and the expulsion plate is activated, outputting a bale that may be slightly oversized at its largest dimension.

A further characteristic of the invention is that the machine, in the event that the expansion volume created by retracting the expulsion plate is not enough to absorb the excess material, the output door is opened and, without interrupting the action of the pressing plate, the expulsion plate is activated, forming a slightly oversized bale in its largest dimension.

The invention comprises the fact that the compact bale, once it has passed through the strapping apparatus, can be wrapped in an automatic, airtight manner in synthetic plastics sheeting.

A further characteristic is that the compact, strapped bale is wrapped in an airtight manner to form, e.g., a 3-dimensional body that is 1800 cm long, 1250 cm wide and 1350 cm high.

Finally, also, it has been envisaged in the invention that under the resistant plate provided with runoff through holes there is a collector for the liquids flowing through said through holes, all as a result of the actual pressing action performed by the pressing plate, which takes said liquids to a purification an/or recovery system, where appropriate, or directly to a legal dumping site.

BRIEF DESCRIPTION OF THE DRAWINGS

In order to facilitate the understanding of the preceding ideas, there follows a description of preferred embodiments of the invention, with reference to the accompanying illustrative drawings, in which.

DETAILED DESCRIPTION OF THE EMBODIMENTS

Figure 1:
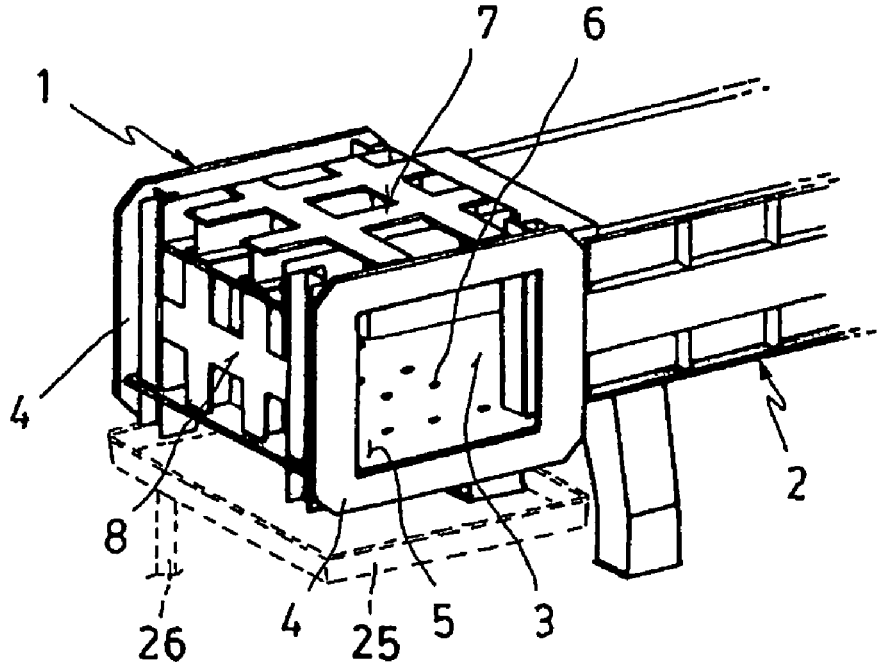
FIG. 1, shows, in a simplified perspective view, an embodiment of a compacting chamber in a pressing machine provided with the improvements of the invention.

FIG. 1 shows a compacting chamber 1 of a pressing machine of which only part of the longitudinal structure 2 thereof can be seen, where the pressing plate with its cylinder and hydraulic equipment is housed and the feeding hopper is located.

As can be seen in FIG. 1, said compacting chamber 1 has a parallelepiped shape, with one medium inner or first, side wall face 3 through which the pressing plate acts, two smaller faces, i.e., second and third side walls, respectively, with respective frames acting as flanges, a larger fourth, bottom wall 5 made up of a flat plate provided with runoff holes 6, a larger top face 7 and a medium outer face 8, with the latter two faces having a lattice structure in this figure.

Figure 2:
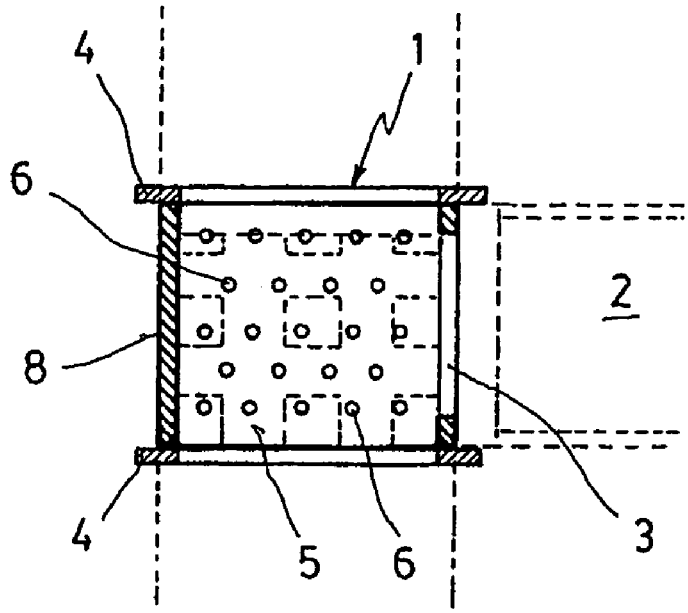
FIG. 2, is a sectional view in a horizontal plane showing the bottom wall of the compacting chamber.

FIG. 2 shows the plate forming larger lower face 5 of the compacting chamber with its runoff holes 6 and the mouth of medium inner face 3.

Figure 3:
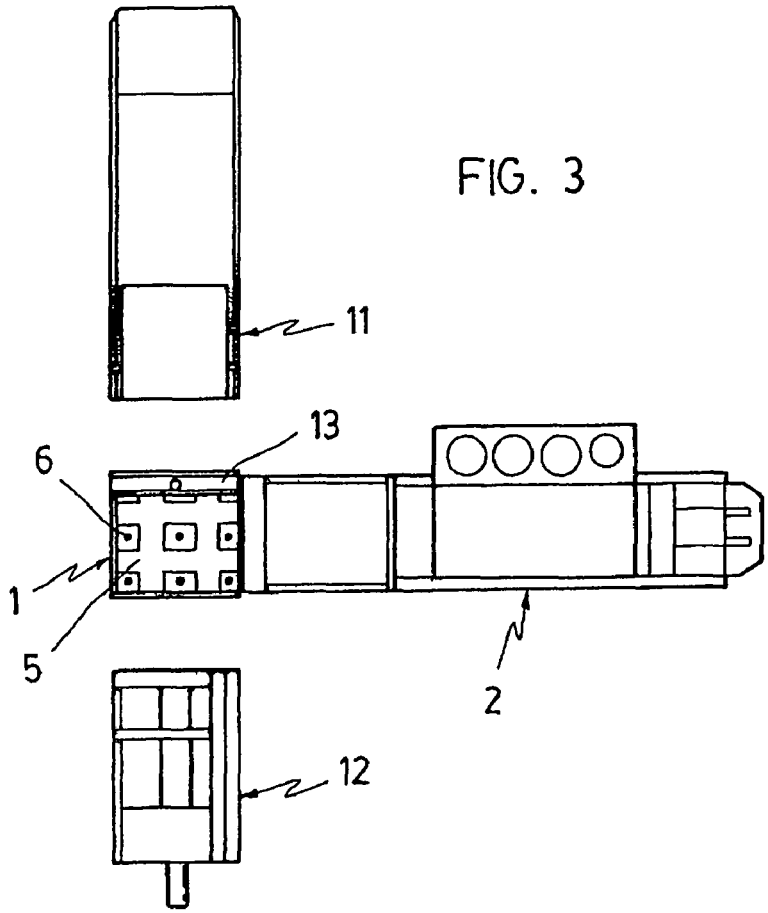
FIG. 3, is a diagrammatic, exploded plan view of a pressing machine provided with the improvements of the invention, which shows the longitudinal structure separately, which comprises the compacting chamber, the pressing plate, the hopper and the driving means, the expulsion equipment and the output equipment.
Figure 4:
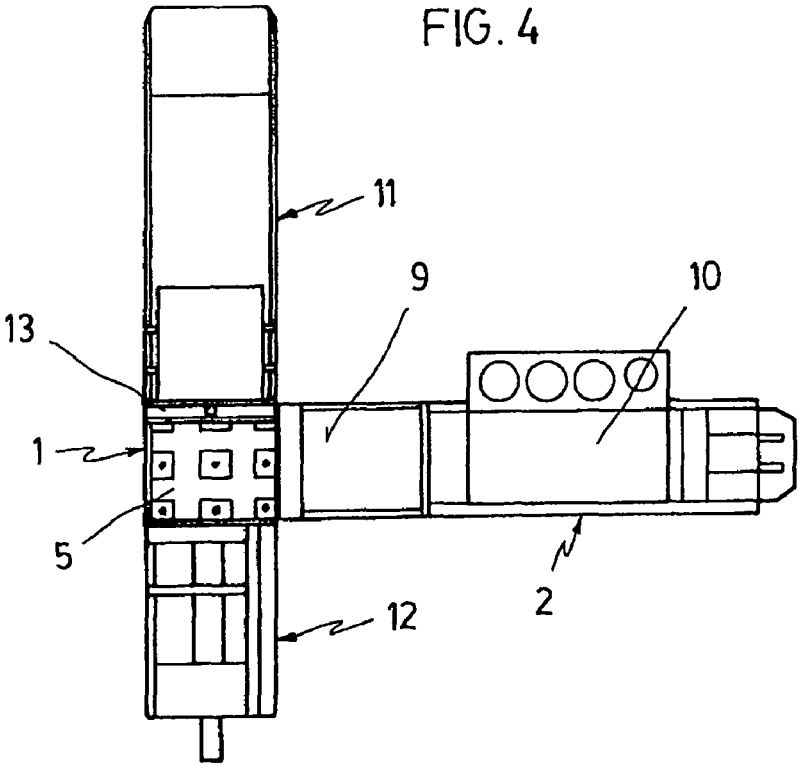
FIG. 4, shows a similar view to the preceding figure, illustrating the three operative components of the machine in one of the two possible relative positions of the overall unit.

FIGS. 3-4 show, in the center, the longitudinal structure 2, with a hopper 9 and a hydraulic unit 10 for driving a pressing plate, at the top end thereof, output equipment 11 is illustrated and at the bottom expulsion equipment 12. Openable door 13 can be seen in the compacting chamber 1.

Figure 5:
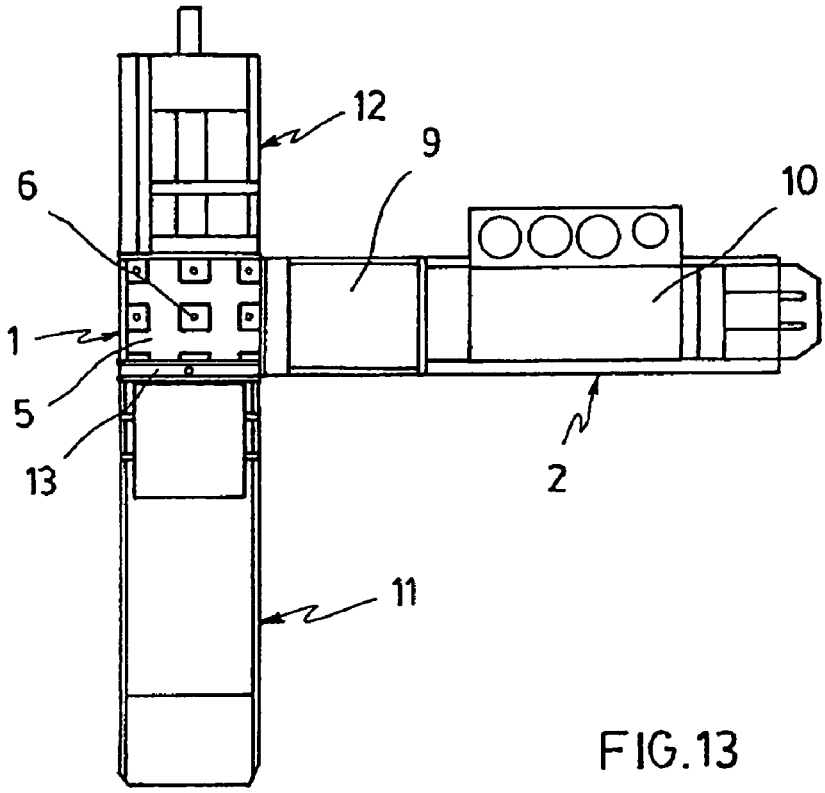
FIG. 5, shows, in a similar view to the preceding figures, another of the two relative positions of the overall unit.

FIGS. 3 and 5 shows that said output 11 and expulsion 12 equipment can be placed to the right or to the left of longitudinal structure 2, whereby the three cited elements can be manufactured independently and then during the factory assembly they can be attached according to the space available.

Figure 6:
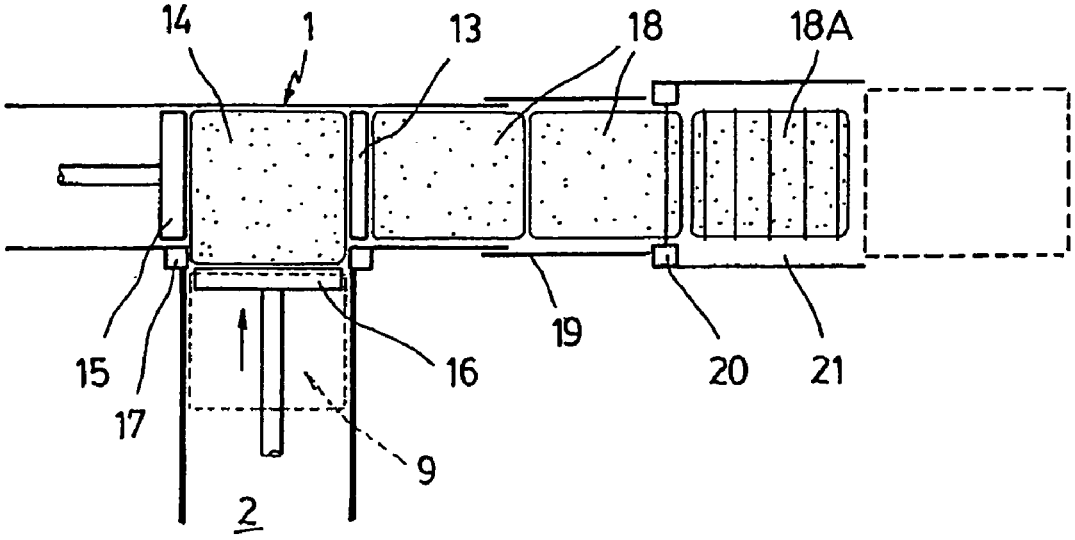
FIG. 6, shows a diagrammatic representation of the pressing of a normal bale, when the pressing plate has still not reached the stopping point.

FIG. 6 shows the normal compacting operation of a normal volume of disgregated material 14, where expulsion plate 15 is stationary, pressing plate 16 is compressing and openable door 13 is closed.

Figure 8:
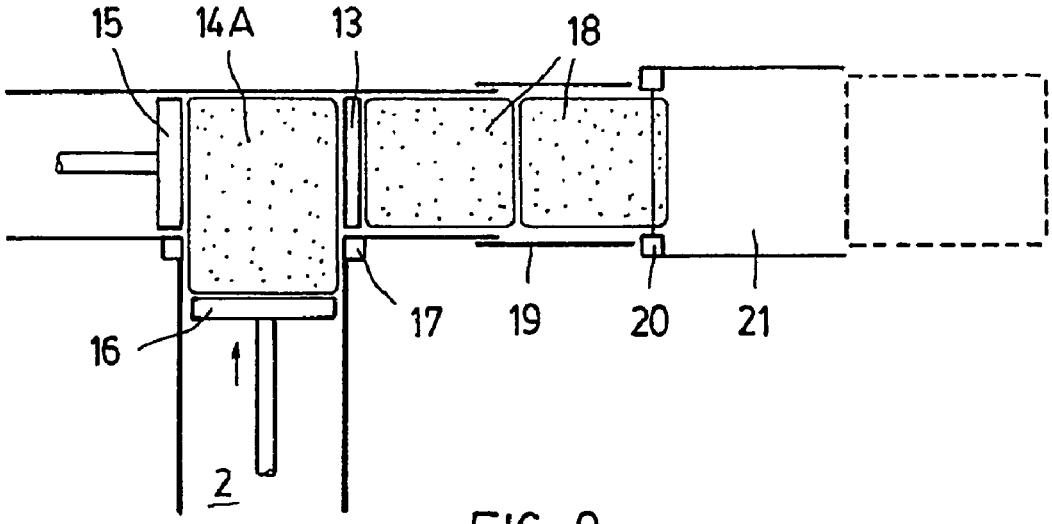
FIG. 8 is a similar view to FIGS. 6 and 7, showing the situation where excess disgregated material does not allow the pressing plate to reach its stopping point, whereby the machine becomes blocked.

Once the pressing plate 16 reaches end stops 17, as sensed by the pressure switch 17*a*, the pressing plate reaches the stopping point, whereby the door 13 opens and the expulsion plate 15 is moved, as illustrated in FIG. 8, to push the bale 18, which was recently compacted, against the previously-formed bales 18 through the inside of a telescopic box 19, which push upon the bale 18 that projects most from a strapping device 20, producing a new bale 18A on loading platform 21 ready for transporting.

FIG. 8 shows the case of compacting disgregated material that has an excess volume 14A while it is being compacted, which is greater than the normal capacity of compacting chamber 1, which excess volume 14A is determined by expulsion plate 15, the larger top and bottom and medium outer faces of chamber 1 and the pressing plate 16 which cannot reach the stopping point set by end stops 17.

Figure 7:
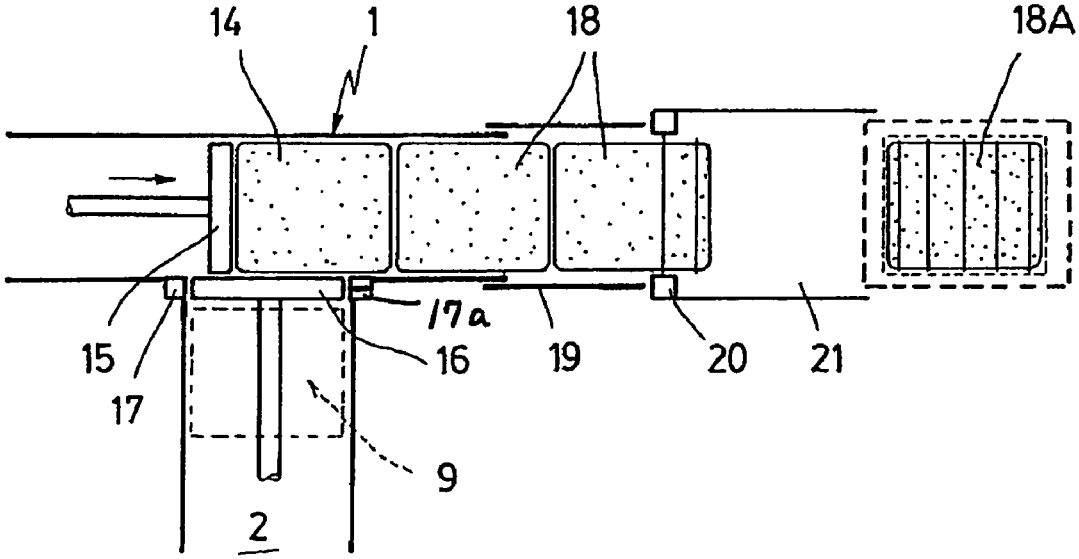
FIG. 7, shows a similar view to the preceding figure, when the pressing plate has reached its stopping point, the openable door has opened upwards and the action of the expulsion plate has started to move the compact bale towards the output equipment and the strapping device.
Figure 9:
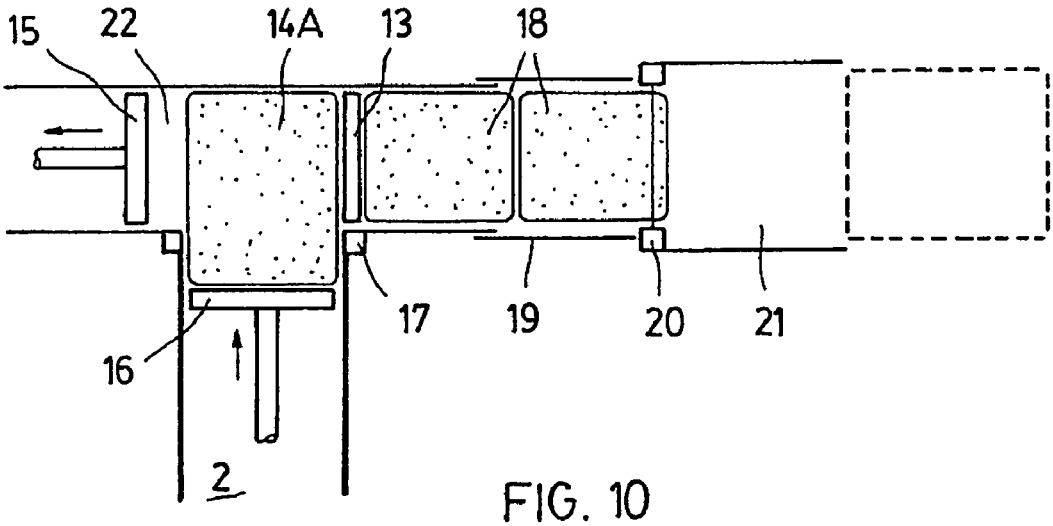
FIG. 9 shows in a similar view to the preceding figures, a possible solution of provisionally increasing the compacting chamber capacity by partially retracting the expulsion plate.
Figure 10:
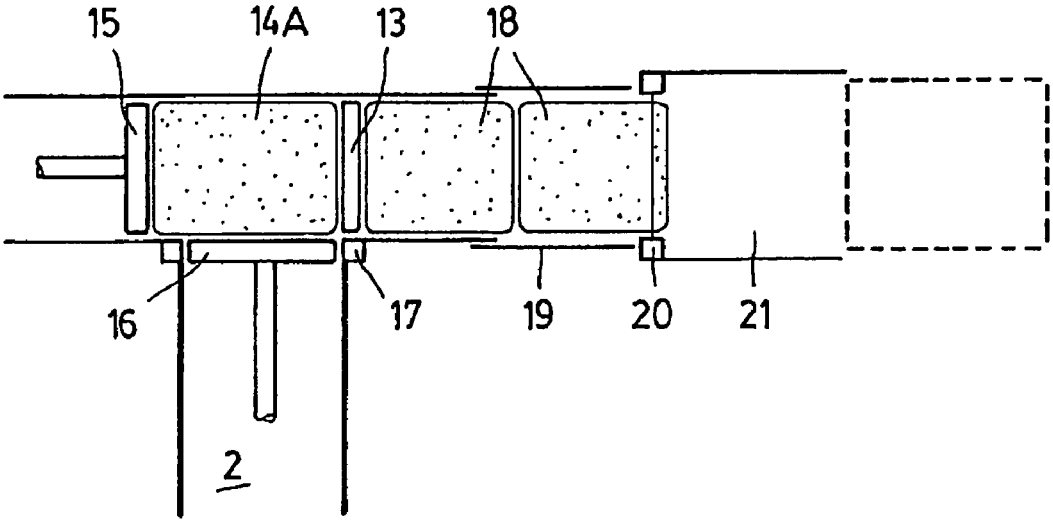
FIG. 10, shows, continuing on from the preceding figure, when the pressing plate has reached its stopping point and a slightly longer bale than normal has been obtained.

Under these circumstances, where the pressing machine has two pressed bales 18 in its telescopic box 19, strapping device 20 and loading platform 21, the solution is adopted whereby expulsion plate 15 is retracted, as shown in FIG. 9, to create an auxiliary space 22 which can house the whole excess volume 14A and to enable pressing plate 16 to reach the stopping point set by end stops 17, as shown in FIG. 10, at which point openable door 13 is raised and the situations shown in FIGS. 6 and 7 are reached, with an extra long bale 14A.

Figure 11:
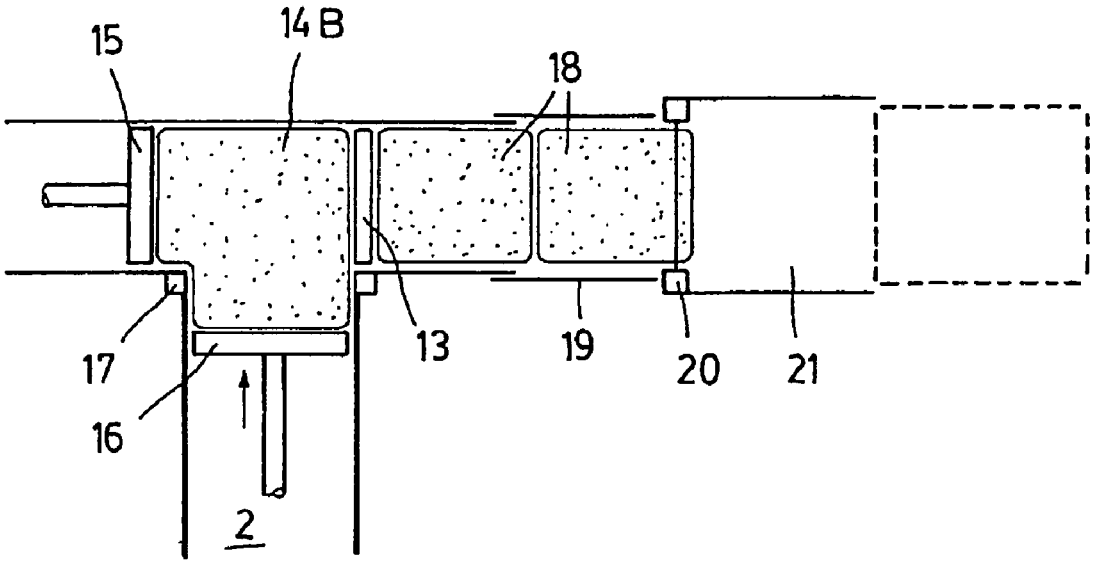
FIG. 11, shows, similar to FIG. 8, the situation when the amount of excess material is greater than the amount that can be absorbed by the movement of the expulsion plate, whereby the openable door opens to allow the bale to expand longitudinally.
Figure 12:
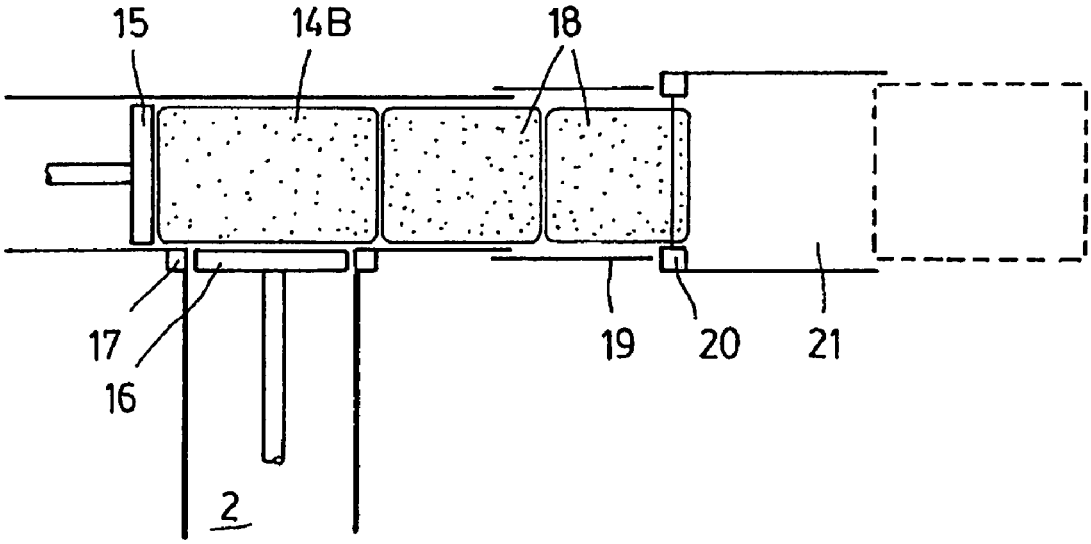
FIG. 12, shows, similar to preceding figures, the moment in FIG. 11 when the bale that is longer than normal is expelled.

FIG. 11 shows the case of FIG. 8 where space 22 gained by retracting expulsion plate 15 is not enough for excess volume 14B, in which case openable door 13 is raised and the pressing plate is taken to end stops 17, as shown in FIG. 12, at which point expulsion plate 15 will move the mass of excess volume 14B towards the outside, without forming a bale or strapping it, where the disgregated material will be returned to hopper 9 thereby removing the obstacle that was preventing the bale from being compacted.

At all events, plate 5 with its runoff holes 6 will enable the squeezed liquids to be removed and collected in a collecting device that takes them to a legal drain.

Frames 4 provided on the smaller faces of compacting chamber 1 act as flanges that enable expulsion equipment 12 and output equipment 11 to be attached with screws.

Figure 13:
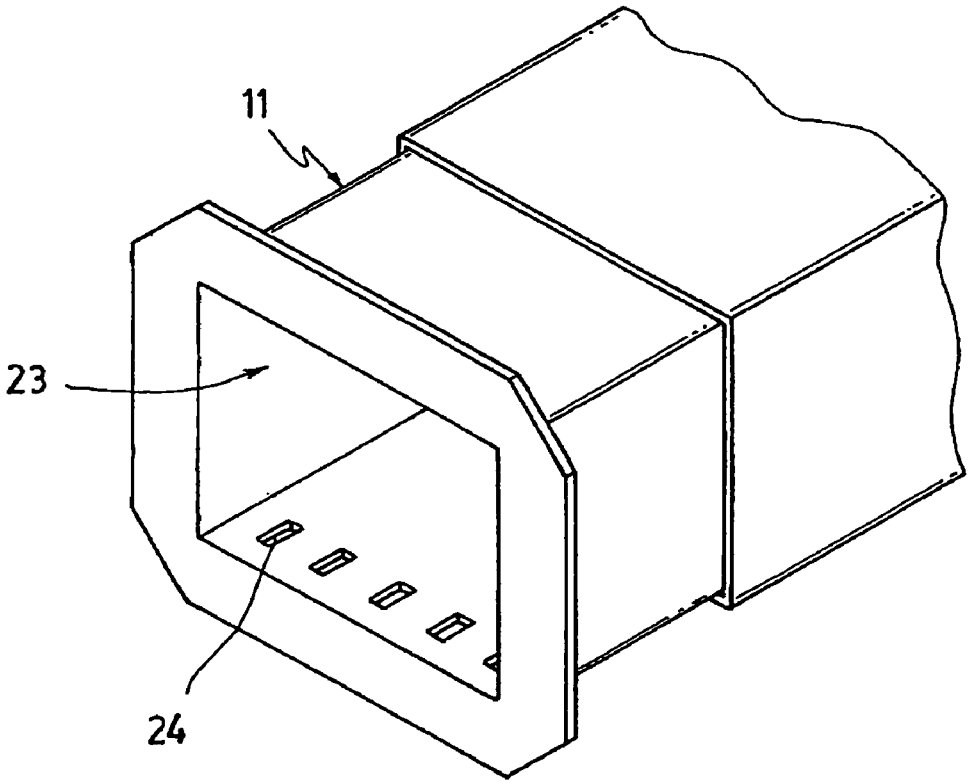
FIG. 13, shows, a perspective view, of the mouth of the telescopic box that backs onto the openable door of the compacting chamber.

FIG. 13 shows a mouth 23 of telescopic box 19 of output unit 11, which box 19 backs onto openable door 13 of compacting chamber 1, and in which through holes 24 are provided, preferably slot type holes, which allow the volume of air contained between a last bale 18 that has been compacted and expelled from compacting chamber 1, which is contained inside said telescopic box 19, and a recently compacted bale 18 that is being introduced into said telescopic box 19.

FIG. 13 shows a mouth 23 of telescopic box 19 of output unit 11, which box 19 backs onto openable door 13 of compacting chamber 1. Through holes 24, preferably slot type holes, are provided in the output equipment to allow air contained between a bale 18 most recently compacted, and a previously-compacted bale 18 that is being introduced into the telescopic box 19 to be expelled from compacting chamber 1.

The invention claimed is:

1. Machine for making bales of disgregated material, comprising:

a compacting chamber having a substantially parallelepiped shape with a first, side wall having an opening towards which a pressing plate moves, a second, side wall having an opening formed therein, a third, side wall, opposite the second wall and having an opening formed therein, a fourth, stationary wall opposite the first wall, and a stopping point for the pressing plate adjacent the opening in the first, side wall;

a bale expulsion equipment having an expulsion plate;

a bale output equipment, wherein the second and third walls are positioned adjacent to and substantially perpendicular to the first side wall, wherein the second and the third walls each includes an attachment frame that allows the bale expulsion equipment and the bale output equipment to be removably connected to either attachment frame, wherein the expulsion plate is movable between a first, extended position into the compacting chamber to expel a compacted bale from the compacting chamber, a second, retracted position at the compacting chamber, and a third retracted position outside of the compacting chamber and inside the bale expulsion equipment; and an output door positioned near the attachment frame to which the output equipment is attached, wherein the output door is movable between a first closed position for compacting the material and a second, opened position to expel a compacted bale, wherein the output door only moves in the vertical direction, irrespective of whether the pressing plate has reached the stopping point, wherein the pressing plate presses the material against the fourth wall, the output door in the first closed position and the expulsion plate to create a compacted bale, wherein, when the machine detects that excess material is in the compacting chamber, when the pressing plate is prevented from reaching the stopping point, the expulsion plate is moved from the second retracted position to the third refracted position to form a space in the bale expulsion equipment, while the output door is in the first, closed position, whereupon the excess material is moved into the space by driving the pressing plate to cause the material to press against the fourth wall and the closed output door and into the space until the pressing plate reaches the stopping point, and wherein the output door is then moved into the second, opened position, and the expulsion plate is moved to the first, extended position, outputting an oversized bale from the compacting chamber.

2. Machine according to claim 1, wherein the expulsion equipment is attached to the attachment frame of the second wall, and the output equipment is attached to the attachment frame of the third wall, with the output door being located at the attachment frame of the third wall.

3. Machine according to claim 1, wherein the expulsion equipment is attached to the attachment frame of the third wall, and the output equipment is attached to the attachment frame of the second wall, with the output door being located at the attachment frame of the second wall.

4. Machine according to claim 1, further comprising a first plurality of through holes formed in a fifth, bottom wall of the compacting chamber for liquids contained in the material being compacted to flow out of the compacting chamber.

5. Machine according to claim 4, further comprising a second plurality of through holes in the output equipment to allow air to move out of the machine.

6. Machine according to claim 1, wherein the machine, if the space is not enough to accommodate the excess material, the output door is moved into the second, opened position before the pressing plate reaches the stopping point, and the expulsion plate is activated, outputting an oversized bale.

7. Machine according to claim 1, wherein the compacted bale is bound after being expelled from the compacting chamber.

8. Machine according to claim 4, further comprising a collector under the fifth wall which collects the flowing liquids.

9. Machine according to claim 8, wherein the collector diverts the collected liquids away from the machine.

* * * * *